US005862671A

United States Patent [19]

Lessard et al.

[11] Patent Number: 5,862,671

[45] Date of Patent: Jan. 26, 1999

[54] PURGE AND ROUGH CRYOPUMP REGENERATION PROCESS, CRYOPUMP AND CONTROLLER

[75] Inventors: Philip A. Lessard, Boxborough; Paul E. Dresens, Arlington; Maureen C. Buonpane, Mansfield; Timothy M. Pulling, Franklin; Alan C. Brightman, Bridgewater; Robert M. Patterson, Burlington; Mark A. Stira, Wilmington; Allen J. Bartlett, Mendon; Stephen J. Yamartino, Wayland; Gary S. Ash, Walpole; James A. O'Neil, Bedford, all of Mass.

[73] Assignee: Helix Technology Corporation, Mansfield, Mass.

[21] Appl. No.: 848,973

[22] Filed: May 2, 1997

Related U.S. Application Data

[63] Continuation-in-part of Ser. No. 619,131, Mar. 20, 1996, abandoned.

[51] Int. Cl.[6] ..... B01D 8/00

[52] U.S. Cl. ..... 62/55.5; 417/901

[58] Field of Search ..... 62/55.5; 41/901

[56] References Cited

U.S. PATENT DOCUMENTS

| | | | |
|---|---|---|---|
| 4,514,204 | 4/1985 | Bonney et al. | 62/55.5 |
| 4,718,240 | 1/1988 | Andeen et al. | 62/55.5 |
| 4,757,689 | 7/1988 | Bächler et al. | 62/55.5 |
| 4,918,930 | 4/1990 | Gaudet et al. | 62/55.5 |
| 5,157,928 | 10/1992 | Gaudet et al. | 62/55.5 |
| 5,228,299 | 7/1993 | Harrington et al. | 62/55.5 |
| 5,259,735 | 11/1993 | Takahashi et al. | 62/55.5 |
| 5,343,708 | 9/1994 | Gaudet et al. | 62/55.5 |
| 5,375,424 | 12/1994 | Bartlett et al. | 62/55.5 |
| 5,400,604 | 3/1995 | Häfner et al. | 62/55.5 |
| 5,450,316 | 9/1995 | Gaudet et al. | 62/55.5 |
| 5,465,584 | 11/1995 | Mattern-Klosson et al. | 62/55.5 |
| 5,513,499 | 5/1996 | DeRijke | 62/55.5 |
| 5,517,823 | 5/1996 | Andeen et al. | 62/55.5 |

FOREIGN PATENT DOCUMENTS 2 065 782 7/1981 United Kingdom .

OTHER PUBLICATIONS

Matsuo, Mukuda et al., Patent Abstracts of Japan, "Starting and Regenerating Method of Cryo–Pump," vol. 012, No. 208 (M–709), Jun. 15, 1988.

*Primary Examiner*—Christopher B. Kilner
*Attorney, Agent, or Firm*—Hamilton, Brook, Smith & Reynolds, P.C.

[57] ABSTRACT

A cryopump is regenerated by roughing the cryopump during purging. Purging and roughing is carried out in first a high temperature mode and then a lower ambient temperature mode. In the lower temperature mode, the cryogenic refrigerator is turned on. If the system fails a rough test after roughing at the lower temperature, it is repurged with the rough valve open.

63 Claims, 6 Drawing Sheets

| |
|---|
| FIG. 5A |
| FIG. 5B |

PURGE AND ROUGH CRYOPUMP REGENERATION PROCESS, CRYOPUMP AND CONTROLLER

RELATED APPLICATIONS

This application is a Continuation-in-Part application of application Ser. No. 08/619,131, filed Mar. 20, 1996, now abandoned, which is incorporated herein by reference in its entirety.

BACKGROUND OF THE INVENTION

Cryogenic vacuum pumps, or cryopumps, currently available generally follow a common design concept. A low temperature array, usually operating in the range of 4 to 25K, is the primary pumping surface. This surface is surrounded by a higher temperature radiation shield, usually operated in the temperature range of 60 to 130K, which provides radiation shielding to the lower temperature array. The radiation shield generally comprises a housing which is closed except at a frontal array positioned between the primary pumping surface and a work chamber to be evacuated.

In operation, high boiling point gases such as water vapor are condensed on the frontal array. Lower boiling point gases pass through that array and into the volume within the radiation shield and condense on the lower temperature array. A surface coated with an adsorbent such as charcoal or a molecular sieve operating at or below the temperature of the colder array may also be provided in this volume to remove the very low boiling point gases such as hydrogen. With the gases thus condensed and/or adsorbed onto the pumping surfaces, a vacuum is created in the work chamber.

In systems cooled by closed cycle coolers, the cooler is typically a two-stage refrigerator having a cold finger which extends through the rear or side of the radiation shield. High pressure helium refrigerant is generally delivered to the cryocooler through high pressure lines from a compressor assembly. Electrical power to a displacer drive motor in the cooler is usually also delivered through the compressor or a controller assembly.

The cold end of the second, coldest stage of the cryocooler is at the tip of the cold finger. The primary pumping surface, or cryopanel, is connected to a heat sink at the coldest end of the second stage of the cold finger. This cryopanel may be a simple metal plate or cup or an array of metal baffles arranged around and connected to the second-stage heat sink. This second-stage cryopanel also supports the low temperature adsorbent.

The radiation shield is connected to a heat sink, or heat station, at the coldest end of the first stage of the refrigerator. The shield surrounds the second-stage cryopanel in such a way as to protect it from radiant heat. The frontal array is cooled by the first-stage heat sink by attachment to the radiation shield or, as disclosed in U.S. Pat. No. 4,356,810, through thermal struts.

After several days or weeks of use, the gases which have condensed onto the cryopanels, and in particular the gases which are adsorbed, begin to saturate the cryopump. A regeneration procedure must then be followed to warm the cryopump and thus release the gases and remove the gases from the system. As the gases evaporate, the pressure in the cryopump increases, and the gases are exhausted through a relief valve. During regeneration, the cryopump is often purged with warm nitrogen gas. The nitrogen gas hastens warming of the cryopanels and also serves to flush water and other vapors from the cryopump. Nitrogen is the usual purge gas because it is relatively inert, and is available free of water vapor. It is usually delivered from a nitrogen storage bottle through a transfer line and a purge valve coupled to the cryopump.

After the cryopump is purged, it must be rough pumped to produce a vacuum around the cryopumping surfaces and cold finger which reduces heat transfer by gas conduction and thus enables the cryocooler to cool to normal operating temperatures. The roughing pump is generally a mechanical pump coupled through a fluid line to a roughing valve mounted to the cryopump.

Control of the regeneration process is facilitated by temperature sensors coupled to the cold finger heat stations. Thermocouple pressure gauges have also been used with cryopumps. Although regeneration may be controlled by manually turning the cryocooler off and on and manually controlling the purge and roughing valves, a separate regeneration controller is used in more sophisticated systems. Wires from the controller are coupled to each of the sensors, the cryocooler motor and the valves to be actuated. A cryopump having an integral electronic controller is presented in U.S. Pat. No. 4,918,930.

The typical regeneration process takes several hours during which the manufacturing or other process for which the cryopump creates a vacuum must idle. Substantial efforts have been made to reduce that regeneration time.

SUMMARY OF THE INVENTION

In accordance with the present invention, a cryopump is regenerated by opening a purge valve to apply a gas purge to the cryopump and warming cryopumping surfaces of the cryopump to high temperatures substantially above ambient to release gases from the cryopump. The cryopump is then cooled to lower temperatures substantially less than the high temperatures and is maintained at the lower temperatures while roughing the cryopump and performing a rough test.

Preferably, the cryopumping surfaces are heated by heaters, and a roughing valve opens the cryopump to a roughing pump during the high temperature purge. Thereafter, the cryopump is cooled to the lower temperatures while the roughing valve is kept open and the gas purge continues. The temperature of the cryopumping surfaces may be lowered from a high temperature of about 330K to a lower temperature of about ambient by turning the refrigerator of the cryopump on and reducing heat input. Subsequently, the purge valve is closed while the lower temperature is maintained, and the roughing valve is kept open to rough the cryopump to a sufficiently low pressure for cryopumping.

In accordance with further aspects of the invention, if the cryopump fails the test for proper roughing at the lower temperatures, it is simultaneously purged and roughed. The system then again closes the purge valve, followed by roughing and testing of the cryopump. Preferably, the purging and roughing of the cryopump after test failure is only at the lower temperature with the cryopump turned on.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF A PREFERRED EMBODIMENT

Figure 1:
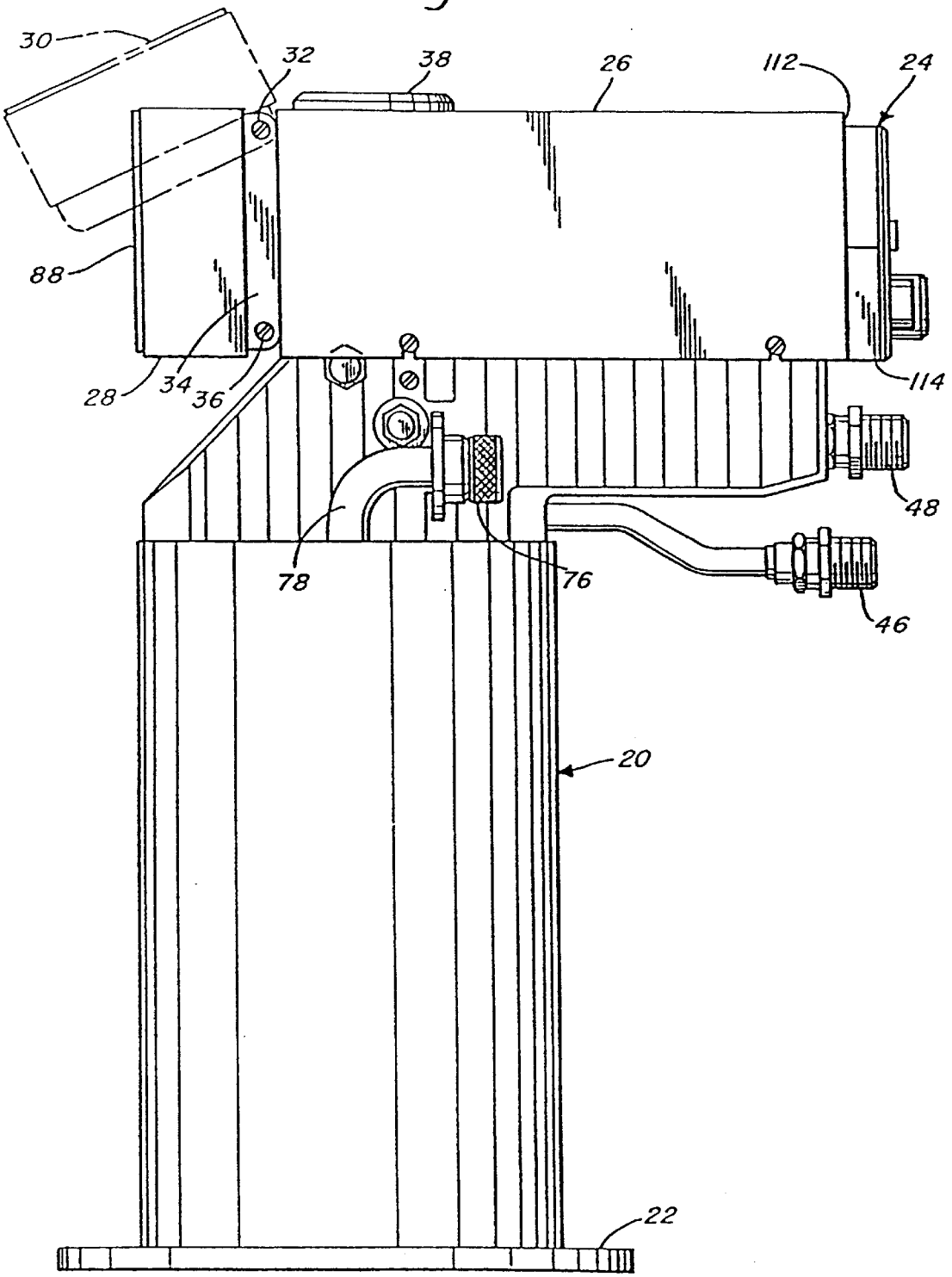
FIG. 1 is a side view of a cryopump embodying the present invention.

FIG. 1 is an illustration of a cryopump embodying the present invention. The cryopump includes the usual vacuum vessel 20 which has a flange 22 to mount the pump to a system to be evacuated. In accordance with the present invention, the cryopump includes an electronic module 24 in a housing 26 at one end of the vessel 20. A control pad 28 is pivotally mounted to one end of the housing 26. As shown by broken lines 30, the control pad may be pivoted about a pin 32 to provide convenient viewing. The pad bracket 34 has additional holes 36 at the opposite end thereof so that the control pad can be inverted where the cryopump is to be mounted in an orientation inverted from that shown in FIG. 1. Also, an elastomeric foot 38 is provided on the flat upper surface of the electronics housing 26 to support the pump when inverted.

Figure 2:
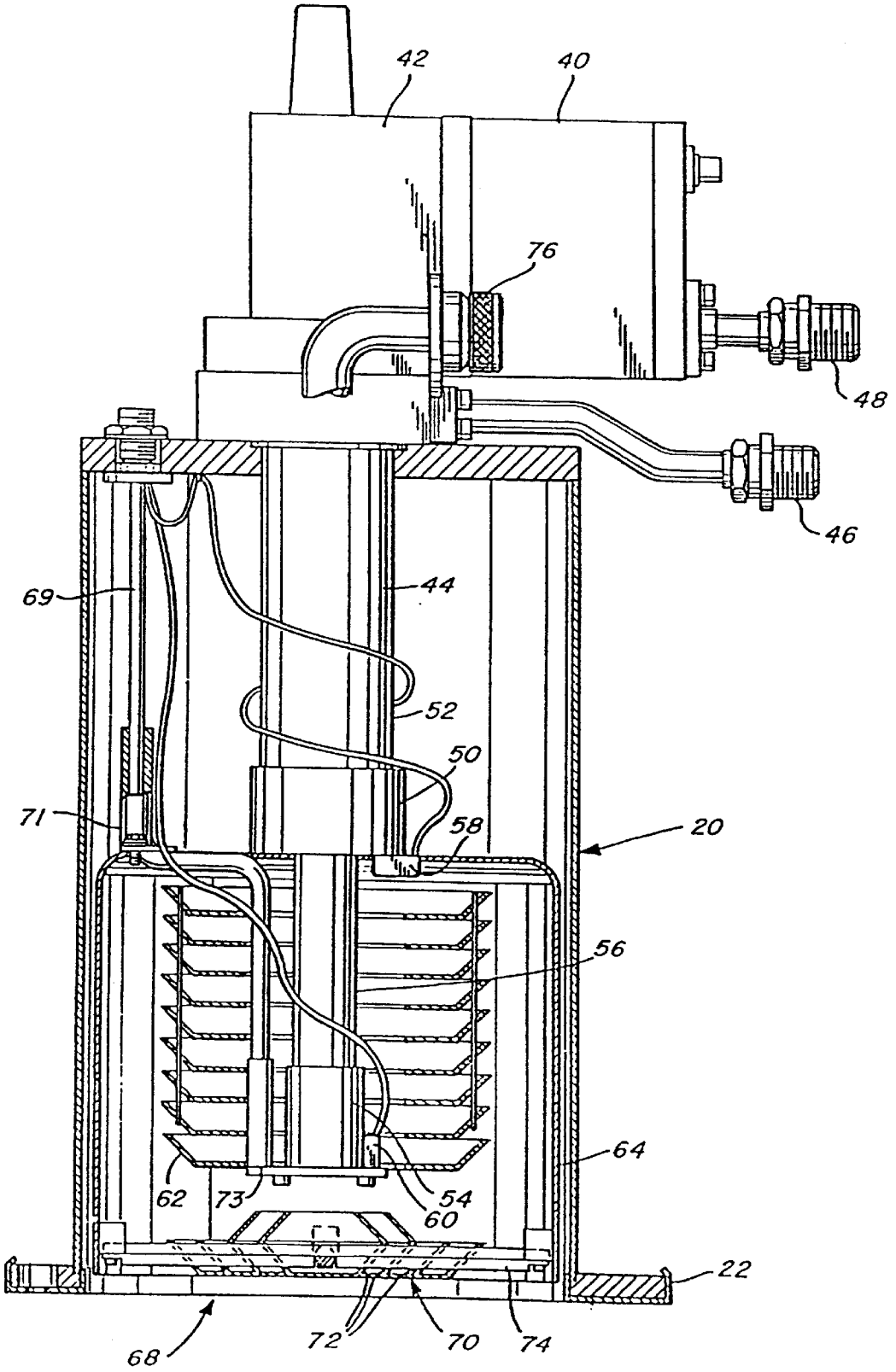
FIG. 2 is a cross-sectional view of the cryopump of FIG. 1 with the electronic module and housing removed.

As illustrated in FIG. 2, much of the cryopump is conventional. In FIG. 2, the housing 26 is removed to expose a drive motor 40 and a crosshead assembly 42. The crosshead converts the rotary motion of the motor 40 to reciprocating motion to drive a displacer within the two-stage cold finger 44. With each cycle, helium gas introduced into the cold finger under pressure through line 46 is expanded and thus cooled to maintain the cold finger at cryogenic temperatures. Helium then warmed by a heat exchange matrix in the displacer is exhausted through line 48.

A first-stage heat station 50 is mounted at the cold end of the first stage 52 of the refrigerator. Similarly, heat station 54 is mounted to the cold end of the second stage 56. Suitable temperature sensor elements 58 and 60 are mounted to the rear of the heat stations 50 and 54.

The primary pumping surface is a cryopanel array 62 mounted to the heat sink 54. This array comprises a plurality of disks as disclosed in U.S. Pat. No. 4,555,907. Low temperature adsorbent is mounted to protected surfaces of the array 62 to adsorb noncondensible gases.

A cup-shaped radiation shield 64 is mounted to the first stage heat station 50. The second stage of the cold finger extends through an opening in that radiation shield. This radiation shield 64 surrounds the primary cryopanel array to the rear and sides to minimize heating of the primary cryopanel array by radiation. The temperature of the radiation shield may range from as low as 40K at the heat sink 50 to as high as 130K adjacent to the opening 68 to an evacuated chamber.

A frontal cryopanel array 70 serves as both a radiation shield for the primary cryopanel array and as a cryopumping surface for higher boiling temperature gases such as water vapor. This panel comprises a circular array of concentric louvers and chevrons 72 joined by a spoke-like plate 74. The configuration of this cryopanel 70 need not be confined to circular, concentric components; but it should be so arranged as to act as a radiant heat shield and a higher temperature cryopumping panel while providing a path for lower boiling temperature gases to the primary cryopanel.

Illustrated in FIG. 2 is a heater assembly 69 comprising a tube which hermetically seals electric heating units. The heating units heat the first stage through a heater mount 71 and a second stage through a heater mount 73.

Figure 3:
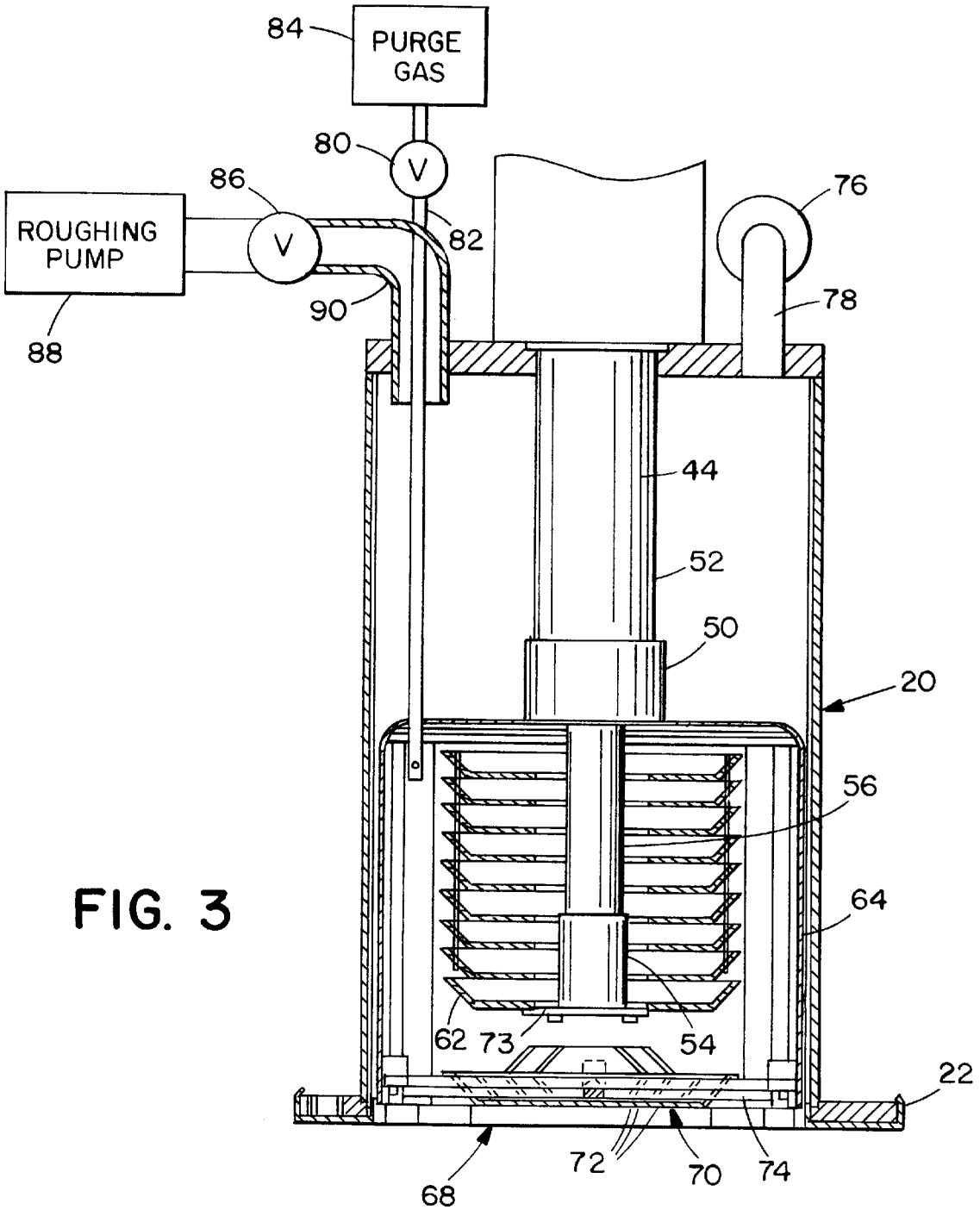
FIG. 3 is a cross-sectional view of the cryopump of FIG. 1 rotated 90° relative to FIG. 1.

As illustrated in FIGS. 1 and 3, a pressure relief valve assembly 76 is coupled to the vacuum vessel 20 through an elbow 78. The pressure relief valve assembly 76 comprises a standard atmospheric relief valve 75 such as disclosed in U.S. Pat. No. 5,137,050. It opens when the internal pressure of the cryopump housing is 1–2 psi above ambient.

To the other side of the motor and the electronics housing 26, as illustrated in FIG. 3, is an electrically actuated roughing valve 86 which connects the interior of the cryopump chamber to a roughing pump 88 through an elbow 90. Extending through and mounted to the elbow 90 is a purge gas tube 82 which delivers purge gas from a purge gas source 84 through an electrically actuated purge valve 80. Purge gas is typically warm nitrogen at 60 psi, and it is blown through the tube 82 into the second stage region within the radiation shield 64 to assist in regeneration.

The refrigerator motor 40, cryopump heater assembly 69, purge valve 80 and roughing valve 86 are all controlled by the electronic module. Also, the module monitors the temperature detected by temperature sensors 58 and 60 and the pressure sensed by a pressure sensor (not shown).

Figure 4:
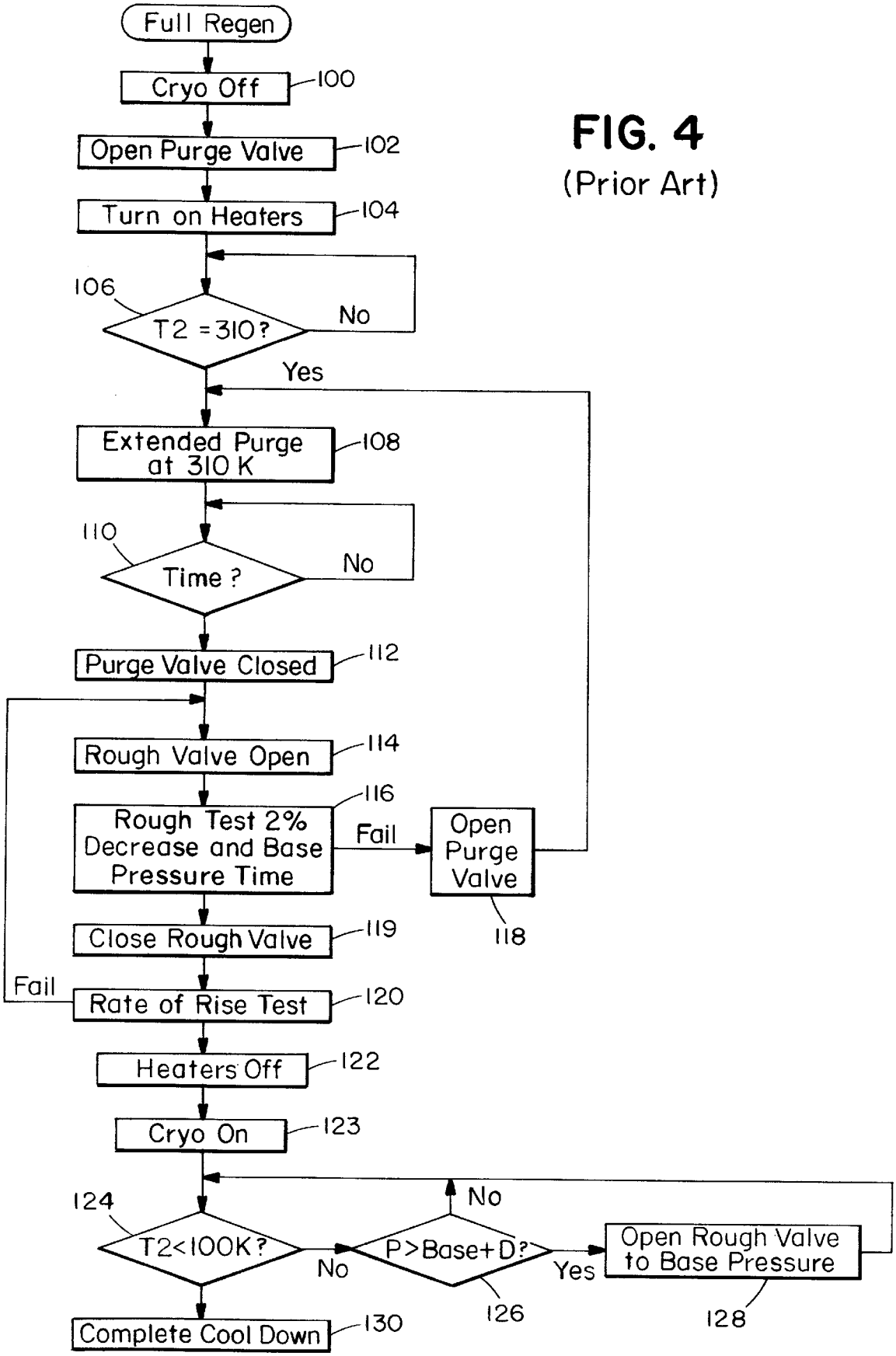
FIG. 4 (Prior Art)
FIG. 4 is a flow chart of a typical prior art regeneration procedure programmed into the electronic module.

A conventional full regeneration process is illustrated in FIG. 4. The cryogenic refrigerator is turned off at 100 and the purge valve 80 is opened at 102 to warm and purge the cryopump. The heaters may also be turned on at 104 to assist in the warming process.

Once the second stage reaches a high temperature of about 310K, the system remains in an extended purge at 108 for a preset time such as 60–90 minutes at 110. The purge valve is closed at 112 and the roughing valve is then opened at 114. The cryopump is then roughed to some preset base pressure such as 75 or 100 microns. During the roughing process, the pressure is monitored in a rough test at 116 to assure that the cryopump is sufficiently clean to rough to the base pressure. Excessive condensibles on the cryopumping surfaces slow the rough pumping process and failure to reach the base pressure within a predetermined time is an indication that the cryopump is not sufficiently free of condensibles. Rather than wait for the full time allotted for reaching base pressure, the rate of pressure decrease is monitored, and if that rate is not at 2% per minute, a rough test failure is indicated even before the allotted time to reduce to base pressure. In the event of rough failure, the purge valve is again opened at 18 to repurge the system, and the system recycles to the extended purge at 108 and 110. After that repurge cycle, the purge valve is again closed at 112 and the rough valve is opened at 114 to continue roughing and the rough test. A number of cycles, typically 20, is preset to limit the number of repurge cycles before the system aborts and signals an error.

Once the system has passed the rough test by reaching the base pressure in the allotted time, the rough valve is closed at 119. The pressure is then monitored in a rate-of-rise test at 120. If the pressure rises too quickly, it is an indication that a significant level of condensibles on the cryopumping surfaces continue to evaporate or that there is a leak in the system. If the system fails the rate-of-rise test, it recycles by opening the roughing valve at 114. The system is typically preset to allow for 10 or even up to 40 recycles of the roughing step.

Once the system has passed the rate-of-rise test at 120, the heaters are turned off at 122 and the cryogenic refrigerator is turned on at 123.

Due to continued internal outgassing, the cryopump internal pressure rises even as the cryopump continues to cool down. That pressure slows recooling and may rise high enough to prevent the recooling of the cryopump. In order to prevent this increase in pressure due to outgassing, the roughing valve 84 is cycled between limits near the base pressure. So long as the second stage temperature remains above 100K at 124, the pressure is checked at 126 to determine whether it has risen to some preset limit, such as 10 microns, above the base roughing pressure. If the pressure increases to that limit, the roughing valve is opened at 128 to pump the cryopump housing back to the base pressure. This keeps the pressure at an acceptable level and also provides further conditioning of the adsorbent by removal of additional gas.

Once the second stage temperature drops below 100K, the roughing valve is kept closed to preclude any damaging backstreaming from the roughing pump, and cool down is completed at 130.

Various modifications of the basic regeneration process have been used depending on the application. For example, warming the cryopumping surfaces to higher temperatures of 330K has been used in circumstances where the condensibles do not evaporate until the higher temperatures. Temperatures much greater than 330K are undesirable because of an effect on epoxy utilized in a conventional cryopump. Opening the rough valve during the purge process has also been suggested in limited applications.

Figures 5, 5A:
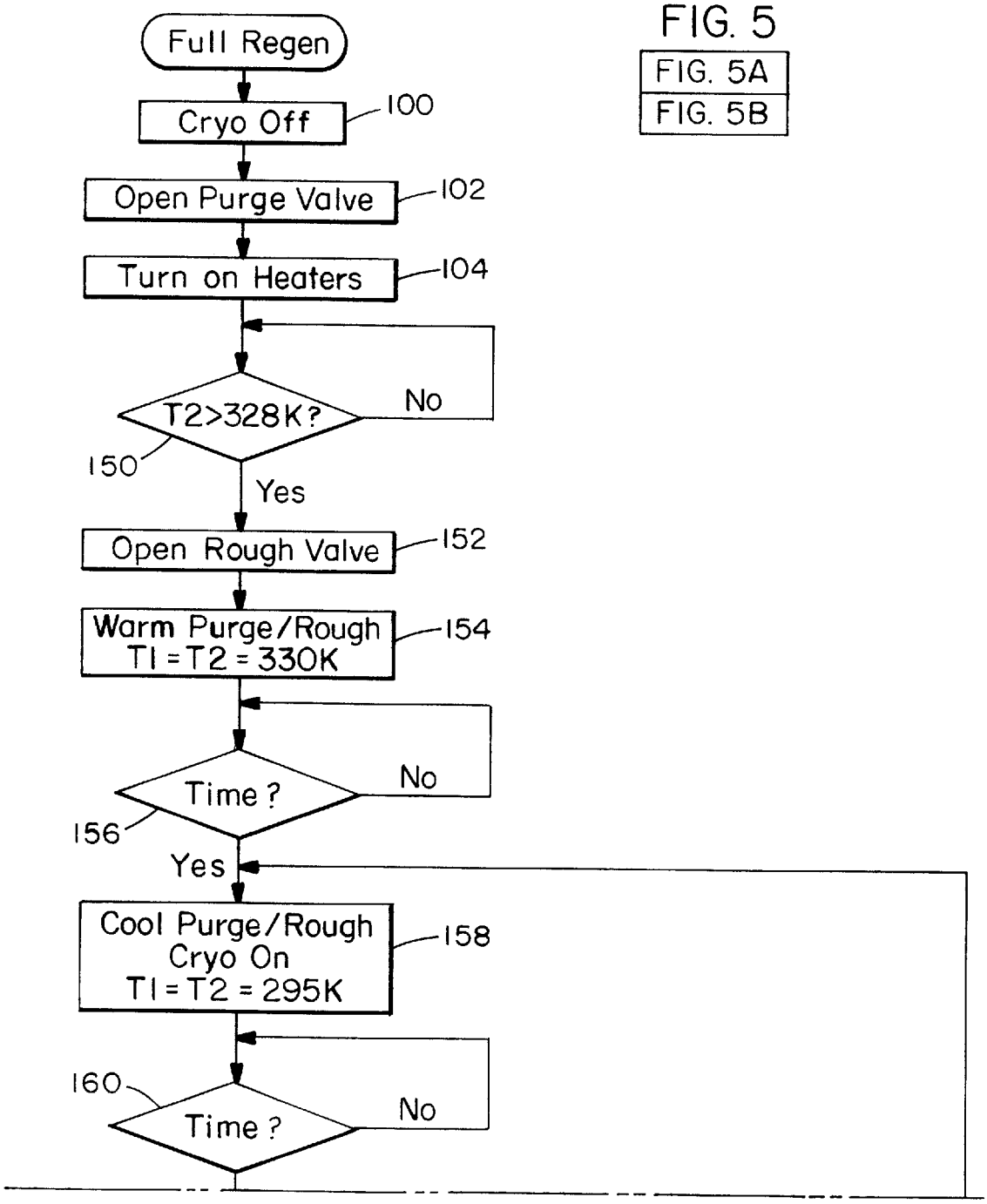
FIGS. 5A and 5B are a flow chart of a regeneration procedure embodying the present invention and programmed into the electronic module.
Figure 5B:
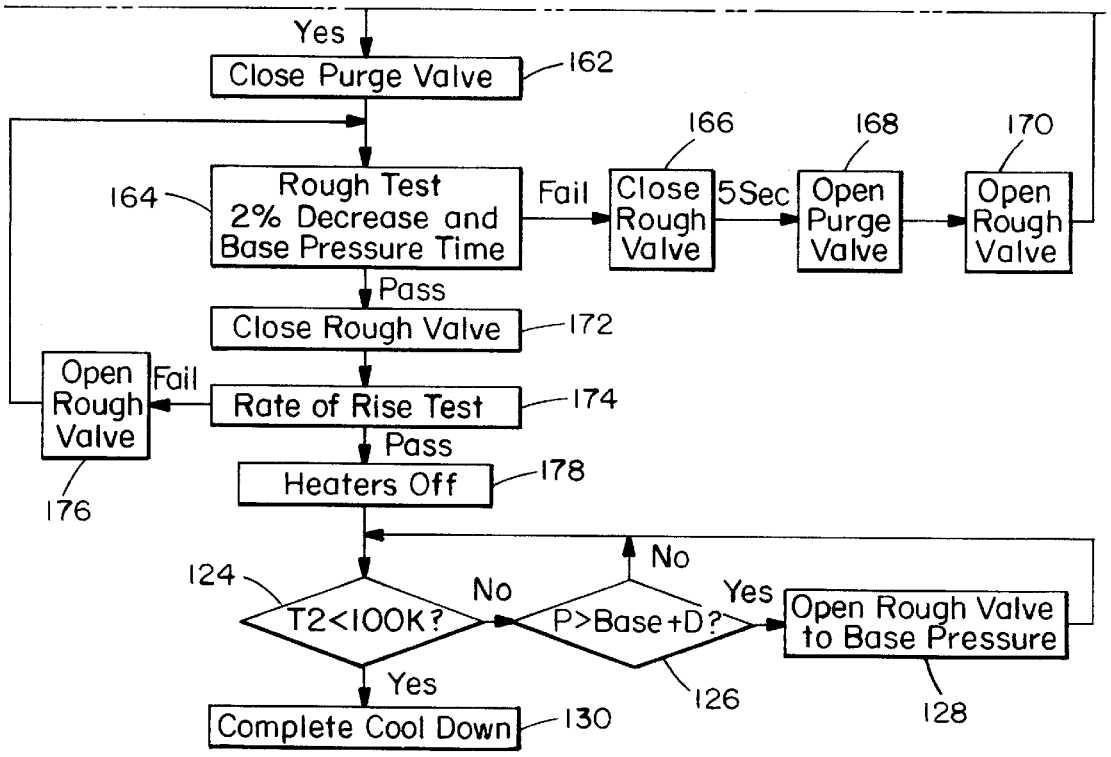

A novel regeneration procedure in accordance with the present invention is illustrated in FIGS. 5A and 5B. As before, the cryogenic refrigerator is turned off at 100, the purge valve is opened at 102 and the heaters are turned on at 104. In this embodiment, the cryopumping surface heats for a set period of time such as four minutes at 150 before the roughing valve is opened at 152. The system is both purged and roughed at 154 while reading and maintaining a high temperature of, preferably, about 330K. This warm purge/rough continues for a preset time of, for example, 60–90 minutes at 156. Unlike prior regeneration procedures, the present procedure calls for a cool purge/rough at 158. During this cool purge/rough, the cryogenic refrigerator is turned on and the system is allowed to cool. The heaters prevent the temperature of the cryopumping surfaces from dropping below a set point, preferably about ambient temperature, or 295K. The cool purge/rough lasts for a preset amount of time such as 15 minutes at 160.

The purge valve is then closed at 162 and the system roughs towards the preset base pressure, keeping the temperature at about 295K using the refrigerator and heaters. The conventional rough test is performed at 164 and, with failure, the roughing valve is closed at 166. The purge valve is then opened at 168 and, unlike in prior procedures, the roughing valve is opened at 170 for a simultaneous purge and rough during the recycling. Preferably, the repurge/rough is at about ambient temperature at 158. The system may repurge/rough up to a preset number of cycles, preferably about 10.

Once the system finally passes the rough test at 164, the roughing valve is closed at 172 and the system is tested for rate of rise at 174, still at about 295K. As before, if the system fails the rate-of-rise test the roughing valve is opened at 176 and the rough test is repeated. The purge valve is left closed during this rerough because the charcoal adsorbent adsorbs sufficient nitrogen to prevent attainment of an acceptable rate of rise. Recycling from the rough test is up to a preset number of cycles, preferably about 40.

Once the system has passed the rate-of-rise test, the heaters are turned off at 178 and the system begins to cool down. As before, the pressure is maintained within a preset limit of the base pressure at 124, 126 and 128 by opening the roughing valve as required until the second stage temperature reaches a preset temperature such as 100K. The cool down is completed at 130.

By rough pumping during the purge operations, the condensibles on the cryopumping surfaces are more efficiently evolved from those surfaces, and with the use of heaters, the heat energy typically provided by the purge gas is not required for heating of the cryopumping surfaces. With choked flow through the purge valve, a constant throughput, preferably of about 2 scfm, is obtained regardless of downstream pressure. Thus, the rough pumping during the purge does not draw an excessive amount of purge gas through the system.

High purge/rough temperatures, preferably, greater then 310K and most preferably about 330K, assist in removal of difficult material such as photoresist or its byproducts found in ion implanter systems. In prior regeneration procedures, it was found that the use of only high temperatures with rough pumping in the extended purge would, in difficult environments such as ion implanters, result in failure to pass the rough test in a preset number of cycles. By cooling the cryopumping surfaces to about ambient temperature during the rough test, condensibles such as water continue to be evaporated and are removed from the system, but more difficult materials such as photoresist from the ion implantation process may be retained on the cryopumping panels, if not already removed during the high temperature purge/rough. The temperature during the rough test and rate of rise test has been chosen to be in the range of 290K to 300K in order to reduce outgassing of materials such as photoresist byproducts yet still allow continued evaporation of water. The particular temperature selected is based on relative considerations of the level of cleanliness obtained with regeneration and the time required for regeneration. With the specific parameters set forth above, regeneration time in an ion implanter system has been reduced from over eight hours, with manual intervention, to less than four hours with automatic operation.

In a typical system, opening the purge valve during roughing raises the pressure seen by the roughing pump to 100 torr or greater. Some roughing pumps do not operate efficiently at that pressure and may become overheated. Accordingly, in order to reduce the load on the roughing pump, a preferred embodiment reduces the average pressure seen by the roughing pump by modulating the purge valve. For example, the purge valve may be opened 0.6 seconds and closed 2.4 seconds in repeated cycles. This has been found to reduce the average pressure to about 20 torr with pressure swings of 10 to 30 torr. Alternatively, a reduced orifice purge valve or proportional control to a variable control purge valve might be used to reduce the continuous purge gas flow to a rate which would provide the reduced average pressure.

The reduced average pressure has an added advantage of more rapid regeneration. At reduced pressures, the molecules which are released from the cryopanels are more rapidly removed by the roughing pump. On the other hand, a sufficient level of purge must be maintained in order to prevent pressure reduction to a level at which the released species are likely to freeze. Any freezing of material in the system greatly increases the regeneration time. Water vapor, for example, will freeze at about 5 torr at room temperature. Accordingly, an average pressure in the range of 10 to 30 torr, with the actual pressure never dropping below about 8 torr, is preferred.

While this invention has been particularly shown and described with references to preferred embodiments thereof, it will be understood by those skilled in the art that various changes in form and details may be made therein without departing from the spirit and scope of the invention as defined by the appended claims. For example, different high and lower level temperatures and other parameters may be selected depending on the gasses and materials being cryopumped and system requirements. During the cooldown from the high temperature to ambient, the system could be roughed without the purge, but with substantial continued evaporation at the high to moderate temperatures, the purge facilitates removal of the evaporated gases. The invention may also be applied to single stage cryopumping systems such as waterpumps.

What is claimed is:

1. A method of regenerating a cryopump comprising:

opening a purge valve to apply a gas purge to the cryopump and warming cryopumping surfaces of the cryopump to high temperatures substantially above ambient to release gases from the cryopump;

cooling the cryopump to lower temperatures substantially less than the high temperatures;

closing the purge valve; and with the purge valve closed, maintaining the lower temperatures while roughing the cryopump and performing a rough test.

2. A method as claimed in claim 1 wherein the step of cooling the cryopump comprises:

opening a roughing valve to a roughing pump while continuing to apply the gas purge and cooling the cryopump to the lower temperatures.

3. A method as claimed in claim 2 wherein the cryopump is cooled to the lower temperatures by turning a refrigerator of the cryopump on.

4. A method as claimed in claim 2 wherein the roughing valve is open while the gas purge is applied at the high temperatures.

5. A method as claimed in claim 4 wherein the high temperature is about 330K and the lower temperature is about ambient temperature.

6. A method as claimed in claim 4 further comprising, if the cryopump fails the rough test, simultaneously purging and roughing the cryopump and then again closing the purge valve and roughing and testing the cryopump.

7. A method as claimed in claim 6 wherein the purging and roughing of the cryopump after test failure is only at the lower temperatures.

8. A method as claimed in claim 7 wherein the purging and roughing at the lower temperatures is with a refrigerator of the cryopump on.

9. A method as claimed in claim 8 wherein the high temperature is about 330K and the lower temperature is about ambient temperature.

10. A method as claimed in claim 1 further comprising:

opening a roughing valve to a roughing pump while applying the purge gas at the high temperatures.

11. A method as claimed in claim 10 wherein the cryopump is cooled to the lower temperatures by means of a refrigerator of the cryopump and maintained at about ambient temperature.

12. A method as claimed in claim 11 wherein the purge valve is left open and the roughing valve is left open as the cryopump is cooled to about ambient temperature.

13. A method as claimed in claim 1 wherein opening of the purge valve is by modulating the purge valve open and closed.

14. A method as claimed in claim 1 wherein the average pressure while purging and roughing is in the range of 10 to 30 torr.

15. A method as claimed in claim 1 wherein the purge valve is a variable control valve.

16. A method of regenerating a cryopump comprising:

purging the cryopump with a gas purge;

rough pumping the cryopump;

testing the cryopump for proper roughing; and if the cryopump fails:

simultaneously purging and roughing the cryopump; and stopping purging and again roughing and testing the cryopump.

17. A method as claimed in claim 16 wherein the purging and roughing of the cryopump is at about ambient temperature.

18. A method as claimed in claim 16 wherein a cryopump refrigerator is turned on during the purging and roughing.

19. A method as claimed in claim 16 wherein the purging is by modulating a purge valve open and closed.

20. A method as claimed in claim 16 wherein the average pressure while purging and roughing is in the range of 10 to 30 torr.

21. A method as claimed in claim 16 wherein purging is through a variable control valve.

22. A method of regenerating a cryopump comprising:

warming cryopumping surfaces of the cryopump to high temperatures substantially above ambient and opening a purge valve to apply a gas purge to the cryopump, and opening a roughing valve to a roughing pump while applying the purge gas at the high temperatures;

turning a refrigerator of the cryopump on and cooling the cryopump to lower temperatures of about ambient temperature while keeping the purge valve and roughing valve open;

closing the purge valve and keeping the roughing valve open while maintaining the cryopump at the lower temperatures to rough pump the cryopump to a base pressure; and performing a rough test while rough pumping the cryopump and, with failure of the cryopump, again opening the purge valve with the rough valve open to repurge and rough the cryopump at the lower temperatures.

23. A method as claimed in claim 22 wherein opening of the purge valve is by modulating the purge valve open and closed.

24. A method as claimed in claim 22 wherein the average pressure while purging and roughing is in the range of 10 to 30 torr.

25. A method as claimed in claim 22 wherein the purge valve is a variable control valve.

26. A cryopump comprising:

a cryopump chamber;

a warm purge gas valve for applying purge gas to the cryopump chamber;

a roughing valve for coupling the cryopump chamber to a roughing pump; and an electronic controller for controlling the purge gas valve and roughing valve, the controller being programmed to control a regeneration process by:

opening the purge valve to apply a gas purge to the cryopump and warming the cryopump to high temperatures substantially above ambient to release gases from the cryopump; and cooling the cryopump to lower temperatures substantially less than the high temperatures and maintaining the lower temperatures while roughing the cryopump and performing a rough test.

27. A cryopump as claimed in claim 26 wherein the controller is programmed to:

open the roughing valve to the roughing pump while continuing to apply purge gas and cooling the cryopump to the lower temperatures; and close the purge valve while keeping the roughing valve open to rough the cryopump to a sufficiently low pressure for cryopumping.

28. A cryopump as claimed in claim 27 wherein the controller cools the cryopump to the lower temperatures by turning a refrigerator of the cryopump on.

29. A cryopump as claimed in claim 27 wherein the controller opens the roughing valve while the gas purge is applied at the high temperatures.

30. A cryopump as claimed in claim 29 wherein the high temperature is about 330K and the lower temperature is about ambient temperature.

31. A cryopump as claimed in claim 29 wherein the controller, if the cryopump fails the rough test, simultaneously purges and roughs the cryopump and then again closes the purge valve and roughs and tests the cryopump.

32. A cryopump as claimed in claim 31 wherein the controller purges and roughs the cryopump after test failure only at the lower temperatures.

33. A cryopump as claimed in claim 32 wherein the controller purges and roughs at the lower temperatures with a refrigerator of the cryopump on.

34. A cryopump as claimed in claim 33 wherein the high temperature is about 330K and the lower temperature is about ambient temperature.

35. A cryopump as claimed in claim 26 wherein the controller is programmed to open a roughing valve to a roughing pump while applying the purge gas at the high temperatures.

36. A cyropump as claimed in claim 35 wherein the controller is programmed to cool the cryopump to the lower temperature by means of a refrigerator of the cryopump and to maintain the lower temperatures at about ambient temperature.

37. A cryopump as claimed in claim 36 wherein the controller is programmed to leave the purge valve open and the roughing valve open as the cryopump is cooled to about ambient temperature.

38. A cryopump as claimed in claim 26 wherein opening of the purge valve is by modulating the purge valve open and closed.

39. A cryopump as claimed in claim 26 wherein the average pressure while purging and roughing is in the range of 10 to 30 torr.

40. A cryopump as claimed in claim 26 wherein the purge valve is a variable control valve.

41. A cryopump comprising:

a cryopump chamber;

a warm purge gas valve for applying purge gas to the cryopump chamber;

a roughing valve for coupling the cryopump chamber to a roughing pump; and an electronic controller for controlling the purge gas valve and roughing valve, the controller being programmed to control a regeneration process by:

opening the purge gas valve to purge the cryopump;

opening the roughing valve to rough pump the cryopump; and testing the cryopump for proper roughing and, if the cryopump fails:

simultaneously opening the purge gas valve and roughing valve to purge and rough the cryopump; and closing the purge gas valve and again rough pumping and testing the cryopump.

42. A cryopump as claimed in claim 41 wherein the controller controls purging and roughing of the cryopump at about ambient temperature.

43. A cryopump as claimed in claim 41 wherein the controller turns on a cryopump refrigerator during the purging and roughing.

44. A cryopump as claimed in claim 41 wherein opening of the purge valve is by modulating the purge valve open and closed.

45. A cryopump as claimed in claim 41 wherein the average pressure while purging and roughing is in the range of 10 to 30 torr.

46. A cryopump as claimed in claim 41 wherein the purge valve is a variable control valve.

47. An electronic controller programmed to control a cryopump regeneration comprising:

first means for opening a purge valve to apply a gas purge to the cryopump and warming the cryopump to high temperatures substantially above ambient to release gases from the cryopump; and second means for cooling the cryopump to lower temperatures substantially less than the high temperatures and maintaining the lower temperatures while roughing the cryopump and performing a rough test.

48. An electronic controller as claimed in claim 32 wherein said second means comprises:

means for opening the roughing valve to the roughing pump while continuing to apply purge gas and cooling the cryopump to the lower temperatures; and means for closing the purge valve while keeping the roughing valve open to rough the cryopump to a sufficiently low pressure for cryopumping.

49. An electronic controller as claimed in claim 48 wherein the controller opens the roughing valve while the gas purge is applied at the high temperatures.

50. An electronic controller as claimed in claim 49 wherein the controller, if the cryopump fails the rough test, simultaneously purges and roughs the cryopump and then again closes the purge valve and roughs and tests the cryopump.

51. An electronic controller as claimed in claim 50 wherein the controller purges and roughs the cryopump after test failure only at the lower temperatures.

52. An electronic controller as claimed in claim 51 wherein the controller purges and roughs at the lower temperatures with a refrigerator of the cryopump on.

53. An electronic controller as claimed in claim 47 programmed to open a roughing valve to a roughing pump while applying a purge gas at the high temperatures.

54. An electronic controller as claimed in claim 53 programmed to cool the cyropump to the lower temperatures by means of a refrigerator of the cryopump and to maintain the lower temperatures at about ambient temperature.

55. An electronic controller as claimed in claim 54 programmed to leave the purge valve open and the roughing valve open as the cryopump is cooled to about ambient temperature.

56. An electronic controller as claimed in claim 47 wherein opening of the purge valve is by modulating the purge valve open and closed.

57. An electronic controller as claimed in claim 47 wherein the average pressure while purging and roughing is in the range of 10 to 30 torr.

58. An electronic controller as claimed in claim 47 wherein the purge valve is a variable control valve.

59. An electronic controller programmed to control a cryopump regeneration comprising:

means for opening the purge gas valve to purge the cryopump;

means for opening the roughing valve to rough pump the cryopump; and means for testing the cryopump for proper roughing and, if the cryopump fails:

simultaneously opening the purge gas valve and roughing valve to purge and rough the cryopump; and closing the purge gas valve and again rough pumping and testing the cryopump.

60. An electronic controller as claimed in claim 59 wherein the controller turns on a cryopump refrigerator during the purging and roughing.

61. An electronic controller as claimed in claim 59 wherein opening of the purge valve is by modulating the purge valve open and closed.

62. An electronic controller as claimed in claim 59 wherein the average pressure while purging and roughing is in the range of 10 to 30 torr.

63. An electronic controller as claimed in claim 59 wherein the purge valve is a variable control valve.

* * * * *